United States Patent [19]

Dirksing

[11] 4,247,070

[45] Jan. 27, 1981

[54] TILT COMPENSATING HANGER FOR TOILET TANK DISPENSING APPARATUS

[75] Inventor: Robert S. Dirksing, Cincinnati, Ohio

[73] Assignee: The Procter & Gamble Company, Cincinnati, Ohio

[21] Appl. No.: 60,088

[22] Filed: Jul. 23, 1979

[51] Int. Cl.[3] ..... F04G 5/06

[52] U.S. Cl. ..... 248/226.5; 248/215; 4/228

[58] Field of Search ..... 248/215, 304, 308, 205 R, 248/309 R, 311.3, 226.5; 222/181; 4/228

[56] References Cited

U.S. PATENT DOCUMENTS

| | | | |
|---|---|---|---|
| 2,534,067 | 12/1950 | Rubin . | |
| 2,811,328 | 10/1957 | Ericson . | |
| 3,178,070 | 4/1965 | Leland . | |
| 3,371,900 | 3/1968 | Jacobs . | |
| 3,477,679 | 11/1969 | Lovitz . | |
| 3,538,520 | 11/1970 | Leavitt . | |
| 3,675,254 | 7/1972 | Brownstein . | |
| 3,768,104 | 10/1973 | Sanderson | 4/228 |
| 3,874,007 | 4/1975 | Dolan | 4/228 |
| 3,952,339 | 4/1976 | Baur | 4/228 |

FOREIGN PATENT DOCUMENTS

| | | | |
|---|---|---|---|
| 1020130 | 11/1977 | Canada | 222/181 |
| 2833770 | 2/1979 | Fed. Rep. of Germany | 4/228 |
| 2744545 | 12/1979 | Fed. Rep. of Germany | 222/181 |

*Primary Examiner*—J. Franklin Foss

*Attorney, Agent, or Firm*—John V. Gorman; E. Kelly Linman; Richard C. Witte

[57] ABSTRACT

A hanger for supporting a toilet tank chemical dispensing apparatus which attaches to the top edge of the tank and which incorporates a tilt compensating feature to accommodate non-vertical toilet tank walls. The dispenser is preferably so mounted on the inner leg of a generally U-shaped hanger which contacts the innermost surface of the toilet tank wall as to be vertically adjustable. The outer leg of the hanger contacts the outermost surface of the toilet tank wall at a pivot point. Resilient means, which direct a force between the inner leg and the inside surface of the toilet tank wall at a point above the pivot point, coact with the pivot point to produce a coupled force system. The coupled force system causes the hanger and dispenser adjustably secured thereto to rotate about the pivot point into a position in which the lowermost end of the dispenser is held adjacent the tank wall, thereby maintaining the dispenser as close to vertical as is feasible despite the tilt inherent in the toilet tank wall.

7 Claims, 10 Drawing Figures

TILT COMPENSATING HANGER FOR TOILET TANK DISPENSING APPARATUS

TECHNICAL FIELD

The present invention relates to hangers for supporting toilet tank dispensers.

Even more particularly the present invention relates to a hanger which supports a toilet tank dispenser from the top edge of the toilet tank wall and which incorporates a feature to compensate for toilet tank tilt.

BACKGROUND ART

Hangers which support dispensers from the toilet bowl rim are well known in the prior art. For example, U.S. Pat. No. 3,675,254, issued to Brownstein on July 11, 1972, discloses a hanger consisting of a hook-shaped arm which clips onto the top edge of a toilet bowl rim. Attached to the arm is a base portion secured to the upper end of an elongated member. The member extends downwardly through a central opening in a block of material composed of the benefit to be dispensed. The block is disposed within the toilet bowl when the arm is clipped onto the rim of the bowl. U.S. Pat. No. 3,538,520, issued Leavitt on Nov. 10, 1970, in a preferred embodiment, provides a holder which consists of a bowl-engaging portion and a lower trough-like solid sanitizing material supporting portion. The bowl-engaging portion, which has a generally U-shaped cross section, is adapted to clip over the top edge of the toilet bowl rim. The trough-like portion, which is disposed within the toilet bowl, contains the benefit to be dispensed. U.S. Pat. No. 3,178,070, issued to Leland on Apr. 13, 1965, provides a supporting and dispensing attachment for an aerosol deodorant container. The attachment, which is U-shaped, consists of an inner vertical wall, an outer vertical wall and a horizontal top wall which are integrally joined and have curved top corners conforming with similarly curved top corner portions of the toilet bowl rim. The aerosol container is attached to the outer vertical wall and is exterior to the toilet bowl when the clip is attached to the rim of the toilet bowl.

Unlike the requirements for hangers typically utilized to support materials within a toilet tank bowl, a major requirement for a hanger designed to suspend a dispenser from the inside of a toilet tank is that the dispenser be supported in as near a vertical position as possible with the lower end of the dispenser securely held against the toilet tank wall. If this design requirement is not met, then (for reasons which will be fully discussed hereinafter) the lower end of the dispenser can project into the flushing apparatus, thereby causing the commode to malfunction. In addition, some dispensers must be supported in a vertical position with at least the lowermost end submerged in the toilet tank water in order to properly function.

If the dispenser is merely clipped onto the top edge of the toilet tank wall in accordance with the teachings of the prior art toilet bowl rim hangers, the requirement for vertical alignment is not likely to be realized. A major reason for this is that toilet tank fabrication, which is normally a molding process, leaves the toilet tank walls with an outward sloping primary flare of typically about 3° from the vertical. Toilet tanks can also have a secondary flare near the top of the toilet tank wall which is also typically about 3° as measured from the primary flare. Toilet tanks can have both a primary and a secondary flare to produce a combined outward flare in the top edge of the toilet tank wall of about 6° from the vertical. Therefore, if the dispenser is merely clipped to the top edge of the wall, the bottom of the dispenser will project toward the center of the tank and away from the innermost surface of the toilet tank wall. To further complicate matters, the tank itself, which is often used as a back rest while the commode is in use, tends to settle rearwardly. In most commodes it is particularly advantageous to support the dispenser from the rear wall because the linkage for the flushing apparatus is attached to the front wall. Therefore, this latter problem of settlement compounds the problem of flare. In addition to the foregoing, some dispensers are buoyant, and their buoyancy increases as the benefit is used up. Thus, if the dispenser is simply clipped to the top edge of the tank, its buoyancy tends to cause the lower end of the dispenser to float away from the toilet tank wall.

Accordingly, it is primary object of the present invention to provide a hanger which supports a toilet tank dispenser from a toilet tank wall in as near a vertical position as possible by providing a feature to compensate for the outward flare of the toilet tank wall and the rearward settlement of the toilet tank.

It is a further object of the present invention to provide a hanger which prevents the lower end of the dispenser from floating into the flushing apparatus.

Still further objects of the present invention include provision of a hanger for a toilet tank dispenser which is reliable and which can easily be manufactured at low cost.

DISCLOSURE OF THE INVENTION

A tilt compensating hanger is provided for a toilet tank dispenser. The hanger comprises a generally U-shaped clip which is adapted to be placed over the top edge of a toilet tank wall. The clip has a central portion located intermediate and secured at opposite ends to an outer leg which contacts the outermost surface of the toilet tank wall, and an inner leg which contacts the innermost surface of the toilet tank wall. The outer leg contacts the outermost surface of the toilet tank wall at a pivot point which, in a preferred embodiment, comprises the free end of the outer leg. The pivot point is inwardly located from the juncture of the central portion and the outer leg. The inner leg has attachment means for securing the dispenser to the inner leg, said attachment means preferably permitting vertical adjustment of said dispenser. In addition to this, the inner leg also has a resilient means secured at least at one end to the inner leg. The free end of the resilient means projects generally in the direction of the outer leg and terminates at a point located above the pivot point of the outer leg. In a preferred embodiment, the resilient means comprises a tab which is attached to the inner leg and is angulated towards the inside surface of the toilet tank wall, said tab forming an acute angle with said inner leg. The resilient means or tab exerts a spring-load between the inner leg and the inner surface of the toilet tank wall in use. The resilient means and pivot point coact to produce a coupled force system which holds the lowermost end of the dispenser against the toilet tank wall, thereby maintaining the dispenser as close to vertical as is feasible despite the tilt inherent in the toilet tank wall.

BRIEF DESCRIPTION OF THE DRAWINGS

While the Specification concludes with claims particularly pointing out and distinctly claiming the subject matter which is regarded as the prevent invention, it is believed the invention will be better understood from the following description taken in connection with the accompanying drawings in which:

DESCRIPTION OF THE PRESENT INVENTION

Figure 1:
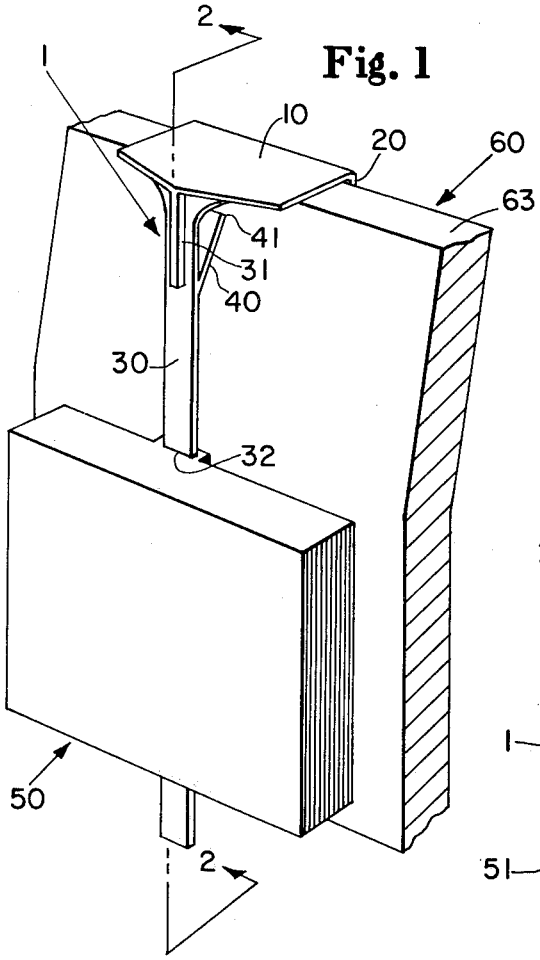
FIG. 1 is a perspective view of a preferred hanger of the present invention attached to the top edge of a toilet tank wall.
Figure 2:
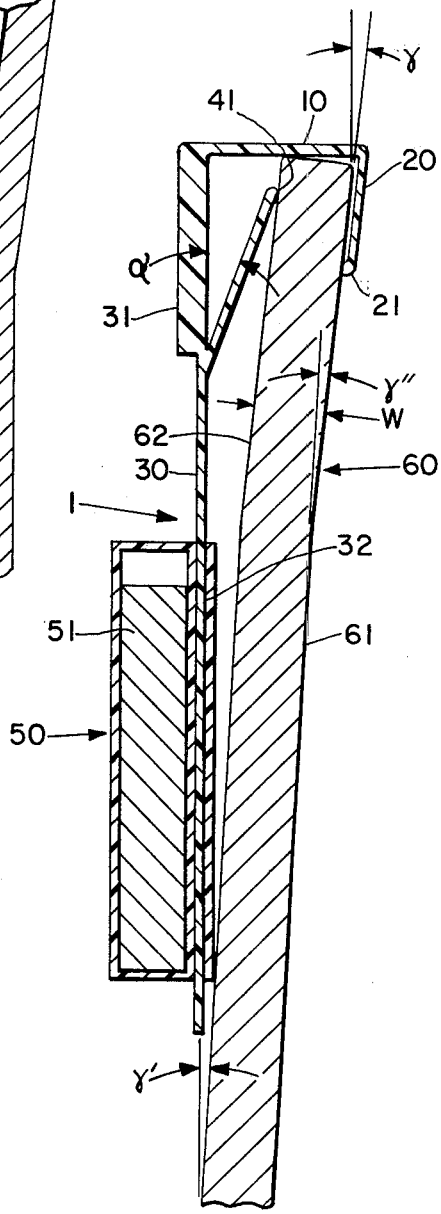
FIG. 2 is a cross-sectional view of the preferred hanger shown in FIG. 1 taken along Section Line 2—2 in FIG. 1.

Referring now to FIGS. 1 and 2, there is shown a preferred hanger 1 of the present invention. While the present invention is by no means limited to the embodiments illustrated, the invention will, for simplicity be described in connection therewith. The hanger 1 comprises a central portion 10, an outer leg 20 and an inner leg 30. If desired, additional rigidity may be provided in inner leg 30 by means of vertical reinforcing member 31 which is preferably integrally formed therewith. The free end of the outer leg 20 contacts the outer surface 61 of the toilet tank wall 60 at pivot point 21. The dispenser 50 which is preferably adjustably secured to inner leg 30 projects into the toilet tank when the hanger 1 is placed over the top edge 63 of the toilet tank wall 60. An inwardly angulated flexible tab 40 which forms an acute angle $\alpha$ with inner leg 30 exerts a springload at point 41. As can be seen by comparing FIGS. 2 and 3, the angle $\alpha$ is decreased upon installation of the hanger in the tank. Tilt compensation is provided by coaction between the springload applied at point 41 and the resisting force applied at pivot point 21 which produce a force couple in the hanger 1. This couple causes the inner leg 30 and consequently, the dispenser 50 secured thereto to rotate about the pivot point into as near a vertical position as possible with the lowermost end of dispenser 50 being held as near the innermost surface 62 of the toilet tank wall 60 as the geometry of the wall will permit.

Figure 3A:
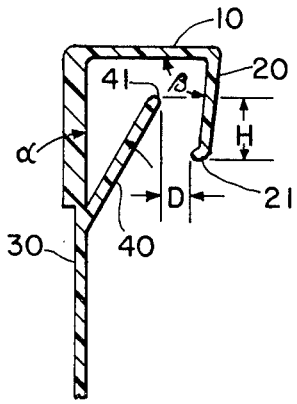
FIG. 3A is a cross-sectional view of the uppermost segment of the hanger of FIG. 1 prior to installation in a toilet tank.
Figure 3B:
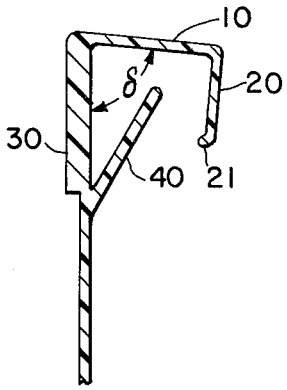
FIG. 3B is a cross-sectional view of the uppermost segment of an alternative hanger embodiment prior to installation in a toilet tank.

The hanger embodiment illustrated in FIGS. 1 and 2, comprises an inverted "U" structure formed by inner and outer legs 30 and 20 respectively and the central portion 10 which are integrally joined. As shown in FIG. 3A, the outer leg 20 forms an acute angle $\beta$ with the central portion 10. The angle $\beta$ provides for tilt compensation by permitting the hanger 1 to pivot about point 21 located at the free end of outer leg 20. Very often there is little clearance between the rear of the toilet tank and the bathroom wall. The arrangement illustrated in FIGS. 1 and 2 allows the hanger 1 to be utilized when there exists little clearance behind the toilet tank.

Figure 3C:
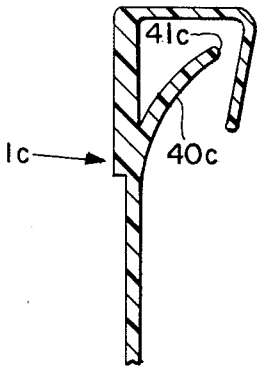
FIG. 3C is a cross-sectional view of the uppermost segment of an alternative hanger embodiment prior to installation in the toilet tank.
Figure 4:
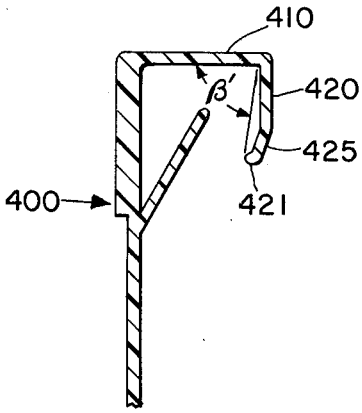
FIG. 4 is a cross-sectional view of the uppermost segment of an alternative hanger embodiment prior to installation in a toilet tank.

Alternatively, in place of the outer leg 20 on the hanger 1 there could be provided an outer leg 420 substantially perpendicular to a central portion 410 and provided with another portion 425 oriented inwardly toward the outermost surface of the toilet tank wall, as generally shown in FIG. 4. In this embodiment, one leg of the angle $\beta'$ is formed by pivot point 421 and the point of intersection between outer leg 420 and central portion 410. This latter embodiment allows the hanger 400 to pivot at point 421, but is somewhat less preferred than the embodiment illustrated in FIGS. 1–3A due to the added clearance requirement at the back of the tank.

Figure 5:
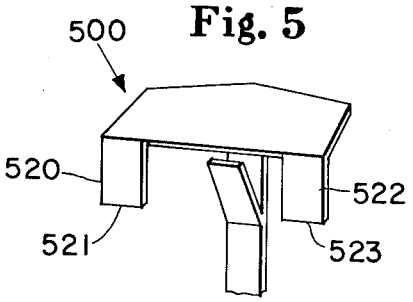
FIG. 5 is a perspective view of the uppermost segment of an alternative hanger embodiment prior to installation in a toilet tank.

As will also be understood by those skilled in the art, the single outer leg design as illustrated in FIGS. 1–3A could be modified and a multiple outer leg design utilized without departing from the spirit and scope of the invention. For instance, FIG. 5 illustrates a hanger 500 generally similar to the hanger illustrated in FIG. 1. In this embodiment the outer leg arrangement is further modified by provision of two outer legs, 520 and 522 having the same length and acute angle as outer leg 20 illustrated in FIGS. 1 and 2 and pivot points 521 and 523 performing as pivot point 21 illustrated in FIGS. 1–3A.

The inner leg 30 of the hanger embodiment 1 illustrated in FIGS. 1–3A extends downwardly substantially perpendicular to central portion 10. As illustrated in FIG. 3B, the inner leg 30 can be given a slight inward angulation defined by acute angle $\partial$, towards the outer leg 20 to induce a slight preload beyond that provided by resilient tab 40 when the hanger is installed on toilet tank wall 60.

The dispenser, which is generally indicated by 50 and which contains benefit 51, may be adjustably secured to the inner leg by a bayonet and sheath arrangement in which a resilient sheath 32 is centrally located on the rear of the dispenser 50. The resilient sheath 32 may be sized sufficiently small to induce frictional forces against the larger inner leg 30, thereby securing the dispenser to the inner leg in use. Once the inner leg 30 is inserted in sheath 32, these frictional forces can be manually overcome and the height of the dispenser 50 on inner leg 30 can be adjusted through manipulation of the dispenser 50 against the inner leg 30. As will be appreciated by those skilled in the art, there are many types of securement means suitable for either rigidly or adjustably attaching the dispenser 50 to the hanger 1. For example, the hanger could be integrally formed with the dispenser body 50 or attached to inner leg 30 by adhesive. It is also possible to utilize a mounting bracket adapted to receive dispenser body 50. Such bracket could be integrally molded to the lower end of inner leg 30. The method utilized must, however, secure the dispenser 50 in such a manner as to maintain the vertical and rotational position of the dispenser 50 relative the inner leg 30 once the unit has been placed in service and the desired vertical position of the dispenser 50 is chosen.

In the hanger embodiment illustrated in FIGS. 1–3A the resilient means embodied in the hanger comprise a resilient tab 40 which is integrally formed with the inner leg 30 of the hanger 1. The tab 40 is inwardly angulated from the inner leg 30 at an acute angle $\alpha$ in the general direction of the outer leg 20. Its free end 41 terminates above the pivot point 21 located at the free end of outer leg 20. The horizontal distance "D" separating points 41 and 21, prior to installation, as measured substantially perpendicular to inner leg 30 must be less than the width "W" of the toilet tank wall 60, as generally shown in FIGS. 1 and 2. When the hanger 1 is placed over the top edge 63 of the toilet tank wall 60, interference with the thicker toilet tank wall causes the resilient tab 40 to deflect towards the inner leg 30. The deflection of the flexible tab produces strain energy, which in turn produces a force at point 41 of the tab 40. The springload thus produced provides a clamping action which prevents a dispenser having positive buoyancy from lifting the entire hanger and riding out of the water while the lid is not present on the tank.

The tilt compensating feature of the hanger arises from coaction between the resilient means and the pivot point 21. The springload imposed by the resilient means or tab 40 in the preferred embodiment produces a force couple since its point of application on the tank wall is above the pivot point 21. The greater the vertical separation "H" of points 21 and 41, as measured substantially parallel to inner leg 30, the greater will be the resultant force couple. This force couple causes the hanger to rotate about pivot point 21, which in turn tends to align inner leg 30 and the dispenser 50 in a vertical position, with the lowermost end of the dispenser being held as closely against the innermost surface 62 of the toilet tank was as its geometry will permit.

Figure 6:
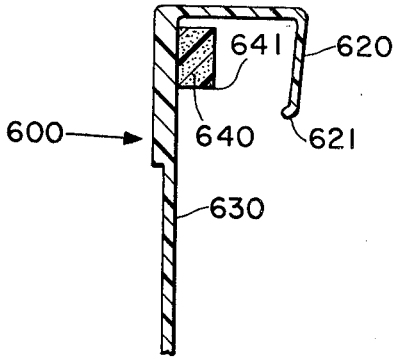
FIG. 6 is a cross-sectional view of the uppermost segment of an alternative hanger embodiment prior to installation in a toilet tank.

It will be understood by those skilled in the art that the exact configuration and construction of the present hanger could be modified without departing from the spirit and scope of the invention. For instance, the tab 40 illustrated in FIGS. 1 through 3A can be curved instead of straight. Such a configuration is illustrated in FIG. 3C. In this illustration curved tab **40*c* is employed on a hanger 1*c* generally similar in design to hanger 1 illustrated in FIG. 1. The free end 41*c* of tab 40*c* can be located at the same point as free end 41 of tab 40 to produce the force couple or moment system required for tilt compensation. As an alternative to tab 40 or 40*c*, any means capable of storing strain energy in a direction substantially normal to the toilet tank wall and located above the pivot point 21 could be utilized. As illustrated in FIG. 6, a hanger 600 generally similar in design to hanger 1 illustrated in FIG. 1 could be provided with a pad of resilient foam 640 secured to an inner leg 630. The pad may be secured to the inner leg 630 by adhesive and is most preferably located so that its lowermost edge 641 contacts the innermost surface of the toilet tank wall at a level above the free end 621 of the outer leg 620, as illustrated in FIG. 6**.

Figure 7:
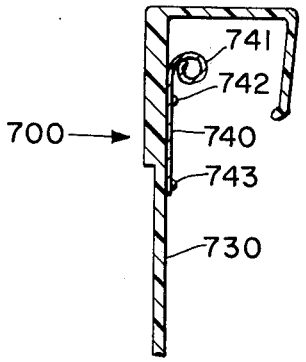
FIG. 7 is a cross-sectional view of the uppermost segment of an alternative hanger embodiment prior to installation in a toilet tank.

Alternatively, as illustrated in FIG. 7, a hanger generally similar in design to the hanger illustrated in FIG. 1 could be provided with a metallic spring 740. The spring 740, in the illustrated embodiment is attached to inner leg 730 by a stake arrangement whereby two holes are provided in the spring which are adapted to receive two bosses 742 and 743 provided for on inner leg 740. The ends of the bosses are then melted to secure the spring 740 to the inner leg 730. The spring 740 is so located on inner leg 730 as to contact the innermost surface of the toilet tank wall at point 741 at about the same level as the free end 41 of the resilient tab 40 illustrated in FIG. 1.

Figure 8:
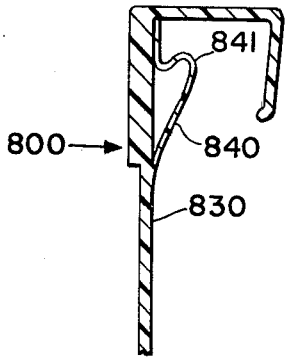
FIG. 8 is a cross-sectional view of the uppermost segment of an alternative hanger embodiment prior to installation in a toilet tank.

An alternative to the metallic spring illustrated in FIG. 7 is a resilient spring-like member 840 integrally formed with the hanger 800, as generally illustrated in FIG. 8. The hanger 800 which is generally similar in design to the hanger 1 illustrated in FIG. 1. Resilient member 840 has its opposing ends secured to inner leg 830, but forms a functional free end 841 which serves as the point of contact with the innermost surface of the toilet tank wall. Resilient member 840 is so located on inner leg 830 as to contact the innermost surface of the toilet tank wall at about the same level as free end 41 of resilient tab 40 illustrated in FIG. 1. The hanger embodiment 800 may be formed entirely of molded plastic or fabricated from any suitable material such as spring steel.

Factors influencing the design of a tilt compensating hanger 1 of the present invention relate to the width "W" and the amount of flare in the top edge of the toilet tank wall. As illustrated in FIG. 2, the total flare in the toilet tank wall 60 as measured from the vertical by the angle $\gamma$ can comprise a primary flare of the lowermost portion of the tank wall 60, as measured from the vertical by the angle $\gamma'$, and a secondary flare of the uppermost portion of the toilet tank wall 60, as measured from the lowermost portion of the toilet tank wall 60 by the angle $\gamma''$. Thus, the angle $\gamma$ typically comprises the sum of angles $\gamma'$ and $\gamma''$. The width "W" of the wall is important because the hanger 1 must be constructed with a horizontal separation "D" between contact points 21 and 41, which is sufficiently smaller than the width "W" of the tank wall to allow the hanger to properly rotate about the pivot point in compensating for flare. In this regard, it has been found that most toilet tank walls are between about 6 mm. and about 15 mm. thick. In order to allow a hanger of the present invention to function effectively on most toilet tanks an exemplary embodiment 1 of the present invention was provided with a central portion 10 of about 19 mm. in length. The amount of tilt compensation provided by a hanger of the present invention is also influenced by the angle $\beta$ the outer leg 20 makes with the central portion 10 of hanger 1. Since the flare in toilet tanks typically varies between about 0° and about 9°, most typically about 6°, a 9° compensation was incorporated on the exemplary hanger embodiment. This was done by inwardly angling outer leg 20 towards central portion 10 so that an included angle $\beta$ of approximately 81°, as measured prior to installation was provided. The overall length of the outer leg 20 was about 19 mm., while the overall length of resilient tab 40 which formed an angle $\alpha$ of about 25°, prior to installation, was about 22 mm. The width of the inner leg 30 which formed an angle $\partial$ of about 90°, prior to installation, was approximately 8 mm. The horizontal distance "D" and the vertical distance "H" separating points 21 and 41 measured about 5 mm. and about 15 mm. respectively, prior to installation. The overall width of the tab 40 was likewise approximately 8 mm. The central portion 10 and the outer leg 20 were given a width of about 80 mm. for stability. The thickness of all of the elements of the hanger was about 1.5 mm. The exemplary hanger was injection molded from polypropylene, as is available from Shell Chemical Company, Houston, Texas.

A dispenser 50 of the type generally disclosed in FIG. 2 of the co-pending, commonly-assigned patent application of Robert S. Dirksing, filed Apr. 18, 1978, assigned Ser. No. 897,477, and entitled "Passive Dosing Dispenser", said application being hereby incorporated herein by reference, has been found to work well with hangers of the present invention.

As will be appreciated by those skilled in the art, the dimensions of the hanger as well as the amount of springload may be varied in accordance with the weight and/or buoyancy of the dispenser to be supported.

The exemplary hanger embodiment described above was found to work well in accomplishing the stated objectives when installed on readily available toilet tanks which ranged in thickness between about 8 mm. and about 15 mm. and exhibited outward angles of flare ranging from essentially 0° to about 7°. In toilet tanks exhibiting essentially no tilt, i.e., 0° angle of flare, the subject invention will clamp the dispenser within the toilet tank in the manner described hereinabove in relation to tanks having flared walls. In such circumstance, the top of the dispenser is slightly tilted away from the toilet tank wall. The bottom of the dispenser is, however, held securely against the innermost surface of the toilet tank wall. The dispenser generally described in FIG. 2 of the aforementioned patent application of Robert S. Dirksing was found to perform in a completely normal manner, whether or not the toilet tank wall exhibited flare when suspended on a hanger of the present invention.

As mentioned hereinabove, hangers of the present invention are preferably formed from flexible plastics such as polypropylene. Acrylonitrile-butadiene-styrene, typically referred to as ABS, and high-impact styrenes are also suitable. Polypropylene is particularly preferred, not only because of its flexibility, but also because of low unit production costs in its formation. It is, of course, feasible to form hangers of the present invention from non-plastic materials such as spring steel. However, these materials are generally higher in cost and involve more expensive forming operations.

A particularly preferred method of forming the hanger is by injection molding. If spring steel were used, a stamping operation could be employed.

It is understood that the forms of the invention herein illustrated and described are to be taken as preferred embodiments. Various changes or omissions may be made without departing from the spirit or scope of the invention as described in the appended claims.

Having thus defined and described the invention, what is claimed is:

1. A tilt compensating hanger for a toilet tank dispenser comprising a generally U-shaped clip to be placed over the top edge of a toilet tank wall, said clip having a central portion located intermediate and secured at opposite ends to an outer leg which contacts the outermost surface of said toilet tank wall and an inner leg to which said dispenser is secured, said inner leg contacting the innermost surface of said toilet tank wall, said outer leg forming a pivot point where it contacts the outermost surface of said toilet tank wall, said pivot point being inwardly located from the juncture of said central portion and said outer leg, said inner leg having attachment means for securing said dispenser to said inner leg, said inner leg also having resilient means secured at least at one end to said inner leg, the free end of said resilient means projecting generally in the direction of said outer leg and contacting the innermost surface of said toilet tank wall at a point above said pivot point, whereby said resilient means exert a springload between said inner leg and the innermost surface of said toilet tank wall in use, said resilient means and said pivot point coacting to produce a coupled force system which holds the lowermost end of said dispenser against said toilet tank wall.

2. The hanger of claim 1 wherein said outer leg is inwardly angulated towards said inner leg to thereby form an acute angle with said central portion and wherein said pivot point comprises the free end of said outer leg.

3. The hanger of claim 1 wherein said resilient means comprises a tab which is attached to said inner leg and is angulated towards said innermost surface of said toilet tank wall, said tab forming an acute angle with said inner leg.

4. The dispenser of claim 1 wherein said resilient means comprise a pad of resilient foam attached to said inner leg, said pad having a free end which projects generally in the direction of said outer leg, the lowermost edge of said pad terminating at a point located above said pivot point on said outer leg.

5. The hanger of claim 1 wherein said resilient means comprises a metallic spring having a lower end connected to said inner leg and an upper free end which projects generally in the direction of said outer leg and which contacts said innermost surface of said toilet tank wall at a point located above said pivot point on said outer leg.

6. The hanger of claim 1 wherein said resilient means comprise a resilient member integrally formed with and secured to said inner leg at both ends, said resilient member having a functional free end which flexes towards said inner leg when said hanger is clipped onto the top edge of said toilet tank wall, said functional free end exerting a force generally in the direction of said outer leg at a point located above said pivot point on said outer leg.

7. A tilt compensating hanger for a toilet tank dispenser comprising a generally U-shaped clip to be placed over the top edge of a toilet tank wall, said clip having a central portion located intermediate and secured at opposite ends to an outer leg which contacts the outermost surface of said toilet tank wall, and an inner leg to which said dispenser is secured, said inner leg contacting the innermost surface of said toilet tank wall, said outer leg being inwardly angulated towards said inner leg to thereby form an acute angle with said central portion, said outer leg having a pivot point at its free end, said inner leg having a resilient tab attached at one end to said inner leg and a free end angulated towards said innermost surface of said toilet tank wall, said tab forming an acute angle with said inner leg, said free end of said tab being located at a point above the pivot point on said outer leg, whereby said tab exerts a springload between said inner leg and the innermost surface of said toilet tank wall in use, said tab and said pivot point coacting to produce a coupled force system which holds the lowermost end of said dispenser against said toilet tank wall.

* * * * *